US006761777B1

(12) United States Patent
Radon

(10) Patent No.: US 6,761,777 B1
(45) Date of Patent: Jul. 13, 2004

(54) HIGH CHROMIUM NITROGEN BEARING CASTABLE ALLOY

(76) Inventor: Roman Radon, 5240 SE. 115th St., Belleview, FL (US) 34420

( * ) Notice: Subject to any disclaimer, the term of this patent is extended or adjusted under 35 U.S.C. 154(b) by 0 days.

(21) Appl. No.: 10/040,357

(22) Filed: Jan. 9, 2002

(51) Int. Cl.[7] ..... C22C 38/18

(52) U.S. Cl. ..... 148/325; 148/324; 148/327; 420/11; 420/12; 420/56; 420/59; 420/64; 420/65; 420/121; 420/128

(58) Field of Search ..... 148/324, 325, 148/327; 420/11, 12, 56, 59, 64, 65, 121, 128

(56) References Cited

U.S. PATENT DOCUMENTS

| | | | | |
|---|---|---|---|---|
| 2,745,740 | A | 5/1956 | Jackson et al. | |
| 3,936,297 | A | 2/1976 | Harltine, III | |
| 4,116,683 | A | 9/1978 | Nikolov et al. | |
| 4,394,169 | A | 7/1983 | Kaneko et al. | |
| 4,487,630 | A | * 12/1984 | Crook et al. | 420/36 |
| 4,523,951 | A | 6/1985 | Andreini et al. | |
| H236 | H | 3/1987 | Maykut | |
| 4,689,198 | A | 8/1987 | Fujiwara et al. | |
| 4,754,950 | A | * 7/1988 | Tada et al. | 251/368 |
| 4,888,153 | A | 12/1989 | Yabuki et al. | |
| 4,929,419 | A | * 5/1990 | Wegman et al. | 420/56 |
| 5,252,149 | A | 10/1993 | Dolman | |
| 5,310,431 | A | 5/1994 | Buck | |
| 5,320,801 | A | 6/1994 | Culling | |
| 5,389,334 | A | 2/1995 | Culling | |
| 6,165,288 | A | 12/2000 | Dwars et al. | |
| 6,168,755 | B1 | 1/2001 | Biancaniello et al. | |
| 6,267,921 | B1 | 7/2001 | Montagnon et al. | |

FOREIGN PATENT DOCUMENTS

| | | |
|---|---|---|
| DE | 701807 | 1/1941 |

* cited by examiner

*Primary Examiner*—Andrew L. Oltmans
(74) *Attorney, Agent, or Firm*—Greenblum & Bernstein, P.L.C.

(57) ABSTRACT

The present invention is directed to a corrosion and erosion resistant High Chromium, Nitrogen bearing alloy, comprising the following composition in wt. %: 28–48 chromium, 0.01–0.7 nitrogen, 0.5–30 manganese, 0.01–5 boron, 0.3–2.5 carbon, up to 0.01–25 cobalt plus nickel, up to 0.01–5 silicon, up to 0.01–8 copper, up to 0.01–6 molybdenum, up to 2% of each one selected from group consisting of zirconium, vanadium, cerium, titanium, tungsten, niobium, aluminum, calcium, and rare earth elements with the balance being essentially iron and other trace elements or inevitable impurities. The alloy has a microstructure comprising hypoeutectic, eutectic, chromium carbides, boride and nitrides in the austenitic matrix, saturated with nitrogen with virtually no secondary carbides and nitrides.

25 Claims, No Drawings

HIGH CHROMIUM NITROGEN BEARING CASTABLE ALLOY

This application was originally deposited on Aug. 6, 2001, in the United States Patent and Trademark Office under the Disclosure Document Deposit Program and was assigned Disclosure Document No. 497,934.

FIELD OF INVENTION

This invention relates generally to the art of alloys and more particularly to a high chromium, nitrogen bearing alloy having high corrosion resistance. The instant invention also relates to a high chromium-nitrogen bearing castable alloy, a high chromium-nitrogen content alloy, and a process for producing the high chromium-nitrogen bearing alloy, and articles prepared from the same. This invention further relates to a corrosion resistant high chromium, nitrogen bearing austenitic alloy which is also excellent in strength at high temperatures and suitable for materials of boilers, chemical plant reactors and other apparatus which are exposed to severely high temperature and corrosion environments at work. The instant invention is also directed to a heat resistant high Chromium, nitrogen bearing austenitic alloy having high strength and excellent corrosion resistance in high temperature corrosive environments. The present also addresses the problem of creating a metal casting material, the wear resistance of which will correspond approximately to common commercial types of white iron, but which additionally will be characterized by high corrosion resistance in aggressive media. In addition to high corrosion and wear resistance, the alloy material according to the invention has good casting characteristics. Consequently it can be produced in conventional high-grade steel foundries. Moreover, the casting material has good working characteristics. Furthermore, the aforementioned positive quantities are primarily a chromium content of 28 to 48 wt. %, a carbon content of 0.3 to 2.5 wt. %, and a nitrogen content of 0.01 to 0.7% which result in a sufficiently high volume proportion of carbides and nitrides. The large increase of the chromium content decreases the chromium depletion of the matrix. With regard to the combination of corrosion resistance and wear resistance, the material according to the invention is decidedly superior compared to the known types of castings previously utilized in applications subjected to hydroabrasive wear. The present invention is also directed to an air-meltable, castable, workable, alloy resistant to corrosion and acids such as sulfuric acid and phosphoric acid over a wide range of acid strengths.

BACKGROUND OF INVENTION

Equipment used in highly corrosive environments typically is constructed of metal alloys such as stainless steel or other high alloys. These alloys are necessary to withstand the extremely corrosive effects of environments in which the equipment encounters chemicals such as concentrated sulfuric acid or concentrated phosphoric acid. A particularly difficult environment is encountered in making phosphate fertilizer. In the digestion of phosphate rock with hot, concentrated sulfuric acid, equipment must resist the environment at temperatures up to about 100° C. The impure phosphoric acid which is produced can be extremely corrosive and contains some residual sulfuric acid. The corrosive effect is often increased by other impurities in the phosphoric acid, particularly by halogen ions such as chloride and fluoride, which are normally present in the phosphate rock feedstock used in the process. An extremely corrosive environment is encountered in the concentration of the crude phosphoric acid.

Phosphate rock deposits at various locations in the world vary greatly in chemical composition. The most severe corrosion environments are typically encountered in processing deposits of phosphate rock which contain a high content of halogens, such as chloride or fluoride.

It is also generally known that increasing the Cr content is effective to improve corrosion resistance of steel. Hi-Chrome alloys containing 23–40% Cr, 0.8–2% C, 2.5% Si, and up to 5% Mo, have been known since the 1930's. See for Example German Patent No 7,001,807. U.S. Pat. No. 5,252,149 represents a modernization of this alloy, followed by the German Patent No. 8,612,044 or No. 4,417,261. It is noted that in both patents the alloys exhibit a high resistance to abrasion and good resistance to corrosion. However, both exhibit poor mechanical properties, especially low toughness, brittleness, sensitivity to heat, sensitivity to notch all of which limit their usefulness. It is evident that their structure contains ferrite (Fe $\alpha$).

The ferritic structure in these alloys is inherently very brittle, and the carbide phase embedded in such a brittle phase, results in a very low toughness, high notch sensitivity, as well as sensitivity to heat. Besides, the ferritic structure supersaturated with Chrome, causes the creation of the sigma phase, which drastically lowers toughness and corrosion resistance.

U.S. Pat. No. 5,320,801 is directed to alloys having the following composition: Cr—27 to 34% by weight, Ni+Co—13 to 31%, Si—3.2 to 4.5%, Cu—2.5 to 4%, C—0.7 to 1.6%, Mn—0.5 to 1.5%, Mo—1 to 4%, and Fe—essentially the balance. The alloy of the '801 patent possesses good toughness, but has very poor hardness and very poor wire resistance and low tensile strength. The hardness of 208 to 354 HB, is similar to that of CD4MCU stainless steel (260–350 HB), which has excellent corrosion resistance, but poor wear resistance. The alloy disclosed and claimed in U.S. Pat. No. 5,320,801 is similar to austenitic, high Nickel stainless steels in that is has good toughness, but very low tensile strength and hardness, as well as poor wear resistance. The Nickel present in corrosion resistant alloys, serves mainly for structural stabilization and adds very little to their corrosion resistance. Good examples of this are the stainless austenitic steels containing 12–35% Ni, which have corrosion resistance approaching that of duplex stainless steels which have a low percentage of Nickel (4–8%), or High-Chrome stainless steels with Ni only up to 4%. The primary elements of stainless alloys are Chromium, Molybdenum and Nitrogen as illustrated in the models used to show how various alloying elements influence the corrosion resistance of stainless steel. For example: Pitting Resistance Equivalent Number, PREN=% Cr+3.3*Mo+16*% N illustrates that Nitrogen is an important, very powerful alloying element of corrosion resistant alloys.

The main flaw of the High-Chrome alloys of the prior art is the difficulty in dissolving of Chrome, Molybdenum and Nitrogen in the matrix, without a negative effect on the mechanical properties of the alloy, such as toughness, tensile strength, brittleness, heat sensitivity and weld ability. This is the result of the precipitation of the sigma phase from alloys saturated with Chrome and Molybdenum. Premature wearing out of pump parts made from the above-mentioned High-Chrome alloys is a common occurrence. The main contributing factors are: very low toughness, brittleness and low endurance. Most often a failure happens with a casting worn thin in an isolated area where, due to the poor mechanical properties of the alloy, a crack develops leading to the eventual disintegration of the otherwise still viable component.

The mechanism for corrosion and erosion in acidic environments of the alloys of the prior art are accelerated corrosion due to the continuous removal of the passive corrosion resistant layer by particles in solids containing corrosive fluid. This is especially evident in alloys containing a higher volume of Chrome and Molybdenum, where significant amount of sigma phase is unavoidable and the metal matrix possesses very poor toughness. In order to restore the passive layer, it is necessary to have the Chrome and the Molybdenum concentration at as high a level as possible.

Increasing the Chrome/Carbon, or Cr+Mo/C ratio, increases corrosion resistance up to the critical point, after which begins the formation of the sigma phase, which drastically reduces the toughness and lowers the corrosion resistance of the alloy by depleting the Chrome in the vicinity of the sigma phase precipitates.

The present invention is based on increasing the ratio expressed by Cr+N/C−N, or Cr+Mo+N/C and Cr+Mo+N+B/C−N by reducing the Carbon in the matrix, while introducing the Nitrogen as a powerful additional alloy element to the High-Chrome alloys where it is in a high concentration in solid solution.

Nitrogen, like Carbon, forms interstitial solids with body-centered-cubic (bcc)-$\alpha$ Iron, and face-centered-cubic (fcc) $\gamma$-iron. The size of the Nitrogen atom is smaller than that of the Carbon atom; in this case, in the $\alpha$, as well as in the $\gamma$ phases, the Nitrogen occupies the interstitial sites easier.

The maximum solubility of Nitrogen in Fe-$\delta$ and Fe-$\gamma$ is several times, to tens of times higher than that of Carbon at the same temperatures, which leads to significant expansion and distortion of elementary lattices. It has a solid solution hardening and strengthening effect much greater than that of Carbon, while maintaining a greater level of toughness.

The solubility limits of Nitrogen in the prior art High-Chrome alloys are a very low 0.15% N maximum. This limit is dictated by an inherently low physico-chemical solubility of Nitrogen and Carbon (0.02 to 0.08 max. C+N) in the structure Fe-$\alpha$, which constitutes up to a maximum of 40% of the alloy in German Patent Nos. 4,417,261 or 8,612,044, as well as the low Manganese content $\leqq$1.5%.

The addition of Nitrogen is the most effective means of improving the mechanical properties of austenitic High-Chrome alloys without having a deleterious effect on ductility and corrosion resistance. In order for Nitrogen to be fully effective as an anti-corrosive agent, and to bring to bear its wide range of positive effects on the castings' mechanical properties, such as increased tensile strength hardness and toughness, without loss of ductility, Applicant discovered that in High-Chrome alloys this can happen with considerable presence of Manganese and Molybdenum as enhancing alloys. In these conditions, Nitrogen dissolves in the solid state, two to four times better than in any other High-Chrome alloy disclosed in the prior art. Similarly in high Manganese stainless steels, which dissolve up to 0.8% Nitrogen, and even 1% under partial to pressure, the tensile strength and the hardness are two to four times higher, with good ductility than in the same steel without nitrogen.

The prior art is silent regarding the high-chromium alloys of the instant invention.

OBJECTS OF THE INVENTION

It is an object of applicants' invention to produce a material of construction suitable for use in processing such phosphate rock which presents a severely corrosive environment.

It is also an object of applicants' invention to produce a corrosion resistant alloy which is high in chromium content and which has an enhanced corrosion resistance.

It is a further object of applicants' invention to produce a highly corrosion resistant alloy which contains silicon in sufficient quantity to render the alloy castable by conventional methods.

It is another object of applicants' invention to produce a highly corrosion resistant alloy which contains silicon.

Still a further object of applicants' invention is to produce a corrosion resistant alloy that is high in chromium content and also contains nitrogen.

It is an additional object of applicants' invention to produce a corrosion resistant alloy which has high strength and hardness properties.

An additional object of the present invention is to provide a High-Chromium, Nitrogen bearing alloy with significant improvement in mechanical properties.

Yet, another object of the invention is to provide a high-chromium, nitrogen bearing alloy having greater resistance to corrosion combined with erosion, particularly in acidic environments containing chlorides, fluorides media, or other impurities.

A further object of the present invention is to provide a High-Chromium, Nitrogen bearing alloy containing a large amount of Nitrogen It is a further object of the present invention to provide novel method of hardening a High-Chromium, Nitrogen bearing alloy by cryogenic treatment.

It is an additional object of applicants' invention to produce a High Chromium, Nitrogen and Boron containing alloy which is erosion and corrosion resistant.

SUMMARY OF THE INVENTION

The instant invention is also directed to a corrosion and erosion resistant high-chromium nitrogen bearing and castable alloy comprising the following composition in wt. %:

28% to 48% Chromium
0.01% to 0.7% Nitrogen
0.5% to 30% Manganese
0.3% to 2.5% Carbon
0.01% to 5% Boron
optionally 0.01% to 6% Molybdenum
optionally 0.01% to 5% Silicon
optionally 0.01% to 8% Copper
optionally 0.01% to 25% Nickel and Cobalt said alloy further containing up to 2% of each of one or more micro-alloying elements selected from the group consisting of: zirconium, vanadium, cerium, titanium, tantalum, tungsten, aluminum, niobium, calcium and rare earth elements with the balance being essentially iron and other trace elements or inevitable impurities and having a microstructure comprising chromium carbides, borides and nitrides in an austenitic matrix, said matrix being of face center cubic crystal structure, super saturated by nitrogen in solid solution form and wherein the austenicity of said alloy is defined by the following ratio $$\frac{\%Ni + \%Co + 0.5(\%Mn + \%Cu) + 30(\%N + \%C) + 5 \times \%B}{\%Cr + \%Mo + \%Si + 1.5(\%Ti + \%Ta + \%V + \%Nb + \%Ce + \%Al)} \geq 1.5.$$

DESCRIPTION OF THE PREFERRED EMBODIMENTS

The present invention relates to a High Chromium alloy and more specifically to a corrosion and erosion resistant High Chromium, nitrogen bearing castable alloy. The present invented alloy is designed for use in the formation by casting of slurry pump parts, such as casings, impellers, suction liners, pipes, nozzles, agitators, valve blades, where the casting parts will be exposed in highly corrosive fluids and abrasive slurries. A typical application for such parts is in the wet processing of phosphoric acid. Industrial phosphoric acid solutions are chemically complex, containing sulfuric acid, hydrofluoric acid, hydrofluoric acid and chlorides, fluorides and gypsum, all highly depassivating species, very detrimental to the parts exposed. Another place where these parts are used is in power plant scrubbers i.e., flue gas desulfurization processes where the parts are exposed to sulfuric components and gypsum.

One purpose of the present invention is to provide a material with high resistance to chloride environments, at the same time the material has extraordinary properties in acidic and basic environments combined with good mechanical properties and high structural stability. This combination can be very useful in applications within for example the chemical industry, where you have problems with corrosion caused by acids and at the same time have a contamination of the acid with chlorides, which further amplifies the corrosive effect. These properties of the alloy in combination with a high strength lead to advantageous design solutions from an economic point of view. There are certainly existing materials with very good properties in acid environments, but these are often steels with high contents of Ni, which makes the costs of such materials excessively high. Another disadvantage with austenitic is that the strength in the austenitic steel is usually considerably low.

Applicant has found empirically that the solubility of Nitrogen in a solid solution in the FerroChrome-Manganese Invented alloys is 0.013 to 0.0155% N maximum with 1% Chrome and minimum 6% Manganese, and the same Molybdenum (2% Mo) as the best enhancement.

The Nitrogen has a much lower affinity to Chrome than Carbon has to Chrome. The above-mentioned properties of Nitrogen in High-Chrome-Manganese alloys cause the Carbon in those alloys to be transformed into the Carbide phase, forming hard eutectic Chromium carbides, with the surplus Carbon being dissolved together with Nitrogen in the matrix.

Nitrogen introduced in a high concentration in solid solution factors much stronger than Carbon on the sigma phase retardation, allowing larger quantities of Chrome and Molybdenum to be dissolved in the Ferro-Chrome-Manganese alloys to enhance passivation.

Nitrogen generally improves corrosion resistance, particularly in Chloride containing media. In stainless steels its effectiveness has been tested and expressed with the factor PREN (Pitting Resistance Equivalent Number) –Cr %+3.3 Mo %+16N %. The higher the level of the passivating elements (Cr, Mo, N), the higher the resistance to the corrosion/erosion.

Additionally, Boron reacts with many elements in the periodic table to form a wide variety of compounds. The strong covalent bonding of most borides is responsible for their high melting points, corrosion resistance and hardness values. The chemical resistance of borides is superior to most either their nitride or carbide counterparts. Because of the larger atomic size of B≈0.91 Å, compared to C≈0.77 Å or N≈0.71 Å, interstitial substitution of boron in the undistorted octahedral site is rare, resulting primarily in boron-boron bonding, for borides—$M_nB_m$. (NiB, CoB, MnB, FeB, CrB)

In addition, nickel, manganese and iron react strongly with boron and form very hard compounds; much harder than their nitride or carbides. For extremely abrasive and corrosive applications boron should be added up to 5% B, the carbon content should be from 0.3% C to 1.2% C and nitrogen 0.4 to 0.6% N.

Over all superior results are realized under this invention by the novel microstructure, with the highly corrosive resistant matrix, preferably austenitic, that is of face center cubic crystal structure, super saturated by nitrogen in solid solution form. The matrix is very hard, tough, non-brittle and embedded with borides, carbides and nitrides, supporting the high corrosive resistant matrix with highly wear resistance.

In practicing the instant invention, it is desired that the matrix contain a high level of Chromium, Molybdenum and Nitrogen in a solid solution, without Chromium, or Molybdenum combined by the sigma phase precipitates. It is also desired that the invented alloys have balanced its elements in accordance with the following inequalities which is a measure of the invented alloy austeniticity:

$$\frac{\%Ni + \%Co + 0.5(\%Mn + \%Cu) + 30(\%N + \%C) + 5 \times \%B}{\%Cr + \%Mo + \%Si + 1.5(\%Ti + \%Ta + \%V + \%Nb + \%Ce + \%Al)} \geq 1.5.$$

According to the present invention, there is provided a corrosion and erosion resistant Chromium-Nitrogen bearing castable alloy, comprising the following composition in weight percent (wt %):

Chromium—28% to 48%

Nitrogen—0.01% to 0.7%

Manganese—0.5% to 30%

Carbon—0.3% to 2.5%

Boron—0.01% to 5%

Molybdenum—0.01% to 6%

Copper—0.01% to 8%

Nickel+Cobalt—0.01% to 25%

Silicon—0.01% to 5%

The alloy of the present invention may also contain up to 2% of an additional element selected from a group consisting of: Zirconium, Vanadium, Cerium, Titanium, Tantalum, Aluminum, Tungsten, Niobium, Calcium, and rare earth elements with the balance being essentially Iron and other trace elements or inevitable impurities.

A particular preferred alloy contains a range in wt. % of the main elements (Chromium, Nitrogen, Manganese, Carbon, Boron, Molybdenum, Copper, Nickel, Cobalt and Silicon) as follows:

Chromium 36%–42%

Nitrogen 0.45%–0.55%

Manganese 4%–15%

Carbon 0.5%–1.6%

Boron—0.01%–%4

Molybdenum—2%–5%

Copper—1%–6%

Nickel & Cobalt—4%–10%

Silicon—0.5%–1.5%

With the preferred composition it is desired that the austenitic matrix contain 0.4 wt. % of solid solution of Nitrogen and 35 to 38% of Chromium plus Molybdenum plus Nitrogen.

Also, due to the targeted addition of the austenite-former nickel and cobalt in the concentration range of 0.01 to 25 wt.-%, it is possible to control the ratio of the ferrite and austenite phases in the matrix in a defined manner. The normally extremely great brittleness of chilled casting types with high carbon contents and a carbide lattice in a ferritic matrix is avoided by the predominant deposition of the chromium carbides in the only austenitic phase. Since the austenitic phase, unlike the ferrite phase, is not embrittled by segregation of intermetallic phases or by segregation processes, the danger of fractures due to stresses between the carbides and the matrix is not as great as it is in the case of a purely ferritic or ferritic-austenitic matrix.

The molybdenum content within the limits 0.01% to 6 weight %, preferably 2 to 4 weight %, and especially 2 to 3 weight %, is important for corrosion resistance, especially in chloride-containing, acidic media.

Also, by varying the alloy components carbon and chromium within the limits 0.3% to 2.5% weight % for carbon and 28% to 48% wt % for chromium, the corrosion resistance and wear resistance of the material of the invention can be adjusted to correspond to a prescribed profile of specifications.

The high chromium, nitrogen bearing alloy composition of the present invention is also highly responsive to a cryogenic hardening process, thereby becoming super-hard. When hardened by the cryogenic treatment, the composition possesses higher abrasion resistance, greater hardness, and a durable matrix without the usual precipitation of secondary carbides.

The alloys of the invention are prepared by conventional methods of melting, and no special conditions, such as controlled atmosphere, special furnace linings, protective slags or special molding materials are required.

In the treatment process of the present invention, the high-chromium, nitrogen bearing castable alloy has many of the alloying elements entirely distributed in the austenitic phase or its transformation products, when subjected to sub-zero treatment of at least −100° F., preferably −100° F. to −300° F., attain much greater hardening than that achieved through conventional high temperature treatments.

Generally, the high-chromium, nitrogen bearing alloys of this invention are made by preparing a molten metal mass of all the required elements in the presence of air or additional nitrogen, pouring castings therefrom, cooling of the castings, and subjecting the castings to a cryogenic cooling treatment to produce the desired hardness. The surface of the casting may be cleaned and finished, either before or after cryogenic cooling. In more detail, the preferred process involves the following steps:

(1) mixing the necessary components to be fed to the furnace;
(2) melting the mixture in the furnace to a pouring condition;
(3) pouring the molten metal composition into an appropriate mold;
(4) letting the mold and the casting therein cool slowly to room temperature under ambient conditions;
(5) cleaning and finishing the surface of the casting, as by grinding or the like to smooth the surface; and,
(6) immersing the finished casting in a cryogenic cooling medium at a temperature of −100° F. to −300° F. for a time sufficient to reach the desired hardness.

To appreciate the present discovery, applicant conducted several mechanical tests as further outlined below which included the following measurements:

Tensile Strength—(Ksi)

Deflection—(mm), 30.5 mm diameter cast bar, 300 mm span.

Impact Energy_—(J), Izot test, unnotched 30.5 mm diameter bar, struck 76 mm above support.

Hardness—(BHN): Brinell test, 3000 KG. Load on 10 mm tungsten carbide boll. For the test, the preferred composition of alloys are chosen from prior art alloys, the present invention and stainless steel for reference.

The specific compositions tested are as follows:

Preferred composition alloys (in wt %) of U.S. Pat. No. 5,252,149

| 1 | 2 | 3 |
|---|---|---|
| Cr 36.6 | Cr 38.2 | Cr 39.3 |
| C 1.9 | C 2.06 | C 2.02 |
| Mn 1.2 | Mn 1.5 | Mn 1.1 |
| Si 1.5 | Si 1.4 | Si 1.5 |
| Ni 2 | Mo 1.2 | Mo 1.8 |
| Cu 1 | Ni 1.2 | Ni 1.6 |
| Balance - Fe plus inevitable impurities | Cu 1.2 | Cu 1.6 |
| | Balance - Fe plus inevitable impurities | Balance - Fe plus inevitable impurities |

Preferred composition alloys (in wt %) of U.S. Pat. No. 5,320,801

| 4 | 5 | 6 |
|---|---|---|
| Cr 29.8 | Cr 32.7 | Cr 34.8 |
| Ni + Co 17.2 | Ni + Co 26.5 | Ni + Co 34.5 |
| Si 3.4 | Si 3.2 | Si 3.5 |
| Cu 1.9 | Cu 3.1 | Cu 3.8 |
| C 1.65 | C 1.28 | C 1.26 |
| Mn 1.1 | Mn 1.5 | Mn 1.6 |
| Mo 0.9 | Mo 1.8 | Mo 2.2 |
| Balance - Fe plus inevitable impurities | Balance - Fe plus inevitable impurities | Balance - Fe plus inevitable impurities |

Present Invention Alloys in Wt %

| 7 | 8 | 8B | 9 |
|---|---|---|---|
| Cr 35.8 | Cr 37.3 | Cr 37.9 | Cr 38.3 |
| N 0.42 | N 0.48 | N 0.4 | N 0.52 |
| Mn 6.1 | Mn 9.8 | Mn 5.2 | Mn 11.1 |
| C 1.26 | C 1.33 | C 1.33 | C 1.41 |
| B 0.2 | B 0.15 | B 3.8 | B 0.1 |
| Mo 3 | Mo 2.6 | Mo 2.6 | Mo 2.2 |
| Si 0.9 | Si 0.8 | Si 1 | Si 0.7 |
| Cu 1.5 | Cu 1.7 | Cu 1 | Cu 1.9 |
| Co 2.1 | Co 0.6 | Co 0.5 | Co 4 |
| Ni 3.25 | Ni 3.6 | Ni 8.2 | Ni 0.2 |
| Balance - Fe plus inevitable impurities | Balance - Fe plus inevitable impurities | Balance - Fe plus inevitable impurities | Balance - Fe plus inevitable impurities |

Alloy Compositions in Wt % of German Pat. 8612044, 4417261

| 10 | 11 | 12 |
|---|---|---|
| Cr 38.8 | Cr 43 | Cr 44 |
| Ni 5 | Ni 8 | Ni 10 |
| Mo 2 | Mo 3 | Mo 3.5 |
| Cu 2 | Cu 2.5 | Cu 2.1 |
| N 0.19 | N 0.09 | N 0.15 |
| Si 1 | Si 1.5 | Si 1.5 |
| Mn 1 | Mn 1.2 | Mn 1.1 |
| C 1.6 | C 1.7 | C 1.6 |
| V 1.2 | | |
| Balance - Fe plus inevitable impurities | Balance - Fe plus inevitable impurities | Balance - Fe plus inevitable impurities |

Stainless Steel Alloy Compositions in Wt % for mechanical Testing

| 20Cb3 | Cd-4MCu + N | 317L |
|---|---|---|
| Cr 20 | Cr 26.5 | Cr 18 |
| Ni 37.5 | Ni 5.5 | Ni 11 |
| Mo 3 | Mo 2.5 | Mo 3.1 |
| Cu 3 | Cu 2.9 | C Min. |
| Nb 0.4 | N 0.23 | |
| C Min | C Min | |
| Balance - Fe plus inevitable impurities | Balance - Fe plus inevitable impurities | Balance - Fe plus inevitable impurities |

The alloys 1, 2, 3, 10, 11 and 12 of the prior art have eutectic microstructure where the matrixes are essentially ferritic (Fe-α).

The German Patent 4,417,261, or 8,612,044, alloys identified as 10, 11 and 12, claim a maximum of up to 40% or Fe-α in the matrix. The phase of Fe-α in the High Chrome alloys inherently posses very low toughness because of the very low solubility of Carbon and Nitrogen in the Fe-α. Even a small, limited addition of Nitrogen has a detrimental effect on the toughness, deflection and heat sensitivity, making the alloy more brittle.

Alloys 4, 5 and 6 of U.S. Pat. No. 5,320,801 are Chrome high Nickel alloys with an austenitic microstructure. Those high Nickel alloys inherently possess the lowest tensile strength, the lowest hardness, as cast above 200 HB, and after hardening from the range of 300 HB, they lose their toughness and corrosion resistance.

As can be appreciated from Table 1 above, the alloys of the present invention 7, 8 and 9 possess the following properties superior to prior art alloys:

- 2 to 3 times greater toughness
- 1.6 to 2.3 times higher tensile strength
- Very high as cast hardness after cryogenic hardening
- Measurable elongation or malleability
- Excellent deflection
- 1.5 to 2.5 higher max. hydraulic pressure vessel test.
- Low heat sensitivity
- Good machinability, especially threadability, which on prior art alloys was very poor
- Best castability with melting and pouring temp. −150° F. lower

TABLE 1

| Sample No. U.S. Pat. No. | Tensile Strength (Ksi) | Elongation % | Deflection (mm) | Impact (J) | Hardness (BHN) | Comments |
|---|---|---|---|---|---|---|
| 5,252,149 | | | | | | |
| 1 | 61 | 0 | 2/3 | 12 19 | 450 | as cast |
| 2 | 64 | 0 | 1.3/1.9 | 11 18 | 460 | |
| 3 | 58 | 0 | 0.9–1.9 | 10 16 | 490 | Heat treatment at 1450° F. for 3 hrs |
| 5,320,801 | | | | | | |
| 4 | 53 | 0 | 8–11 | 22–26 | 360 | Sample: |
| 5 | 54 | 0.3–0.6 | 9–13 | 26–34 | 330 | Hardened at 1400° F. for 4 hrs |
| 6 | 48 | 0.3 0.5 | 8–13 | 22 31 | 320 | Hardened at 1400° F. for 4 hrs |
| Present invention | | | | | | |
| 7 | 95 | 0.5–1.1 | 14–18 | 48–59 | 512 | Cryogenic C hardened at −300° F. |
| 8 | 111 | 0.4–1.0 | 10–16 | 41–49 | 450 | Heat Treated |
| 8B | 109 | 0 | 8–12 | 30–36 | 530 | As cast |
| 9 | 95 | 0.3–0.6 | 9–12 | 36–47 | 490 | as cast |
| German Patents 4,417261, 8,612,049 | | | | | | |
| 10 | 68 | 0 | 1.5–2.2 | 11–16 | 500 | Heat treatment at 1800° F. for 2 hrs |
| 11 | 65 | 0 | 1 2.0 | 10–15 | 450 | |
| 12 | 64 | 0 | 0.6 1.6 | 8–14 | 490 | |

The alloys of the prior art as well as the alloys of the present invention are subjected to corrosion test to show the superiority of the alloys of the instant invention:

The Corrosion Tests are conducted in synthetic $P_2O_5$ acid at 80° C., with a chloride content of from 1000 to 3000 ppm. Agitated, 96 hr test. (mmy). The results of the corrosion tests are summarized in Table 2.

TABLE 2

| Sample No. Patent No. | Hardness (BHN) | Chloride Content (PPM) | Corrosion Rate (mmy) | PREN = % Cr + 3.3 × % Mo + 16 × % N |
|---|---|---|---|---|
| U.S. Pat. No. 5,320,801 5 As cast | 260 | 1000 | 17 | $PREN_5$ = 38 |
| | | 2000 | 28 | |
| | | 3000 | 56 | |
| 5 Hardened At 1400° F./4 hr | 330 | 1000 | 23 | |
| | | 2000 | 36 | |
| | | 3000 | 65 | |
| U.S. Pat. No. 5,252,149 2 as cast | 460 | 1000 | 15 | $PREN_2$ = 42 |
| | | 2000 | 23 | |
| | | 3000 | 49 | |
| Present Invention 8 As Cast | 450 | 1000 | 8 | $PREN_8$ = 53 |
| | | 2000 | 11 | |
| | | 3000 | 16 | |
| Stainless Steel 20Cb-3 | 180 | 1000 | 13 | PREN = 30 (20Cb-3) |
| | | 2000 | 14 | |
| | | 3000 | 32 | |
| Stainless Steel CD-4MCuN | 280 | 1000 | 11 | PREN = 38 |
| | | 2000 | 15 | |
| | | 3000 | 19 | |
| CD-4MCuN Hardened | 330 | 1000 | 17 | CD-4MCuN |
| | | 2000 | 28 | |
| | | 3000 | 45 | |
| Stainless Steel 317L | 185 | 1000 | 0.68 | PREN = 38 (317L) |
| | | 2000 | 1.1 | |
| | | 3000 | | |

The following conclusions can be drawn from Table 2:

The High Chrome alloy No. 5 of U.S. Pat. No. 5,320,801 containing −26% Nickel, has a lower corrosion resistance than alloy No. 2 of prior art U.S. Pat. No. 5,252,149, where Nickel content is only 1%.

The same conclusion applies to the stainless steel alloy 20Cb3, in which the Nickel content is 37%. The alloy CD4MCuN contains only 5% Ni. The main function of Nickel in corrosion resistant alloys is as a structural component.

The No. 8 High Chrome-Nitrogen bearing alloy of the present invention, contains only 3.6% Nickel, but 0.48% Nitrogen which is a very powerful corrosion inhibitor. Nitrogen interacts with the Chlorides and somehow buffers their detrimental effect on the alloy. The present invented alloy No. 8 with the higher PREN=53, has 2 to 3 times better corrosion resistance than the patented alloys No. 5 and No. 2. Alloy No. 8 of the present invention containing high levels of Chrome, Molybdenum with a high concentration of Nitrogen, possesses the best corrosion resistance in acidic environments containing high levels of Chlorides.

Prior art alloys and the alloys of the present invention are also subjected to corrosion erosion tests as shown below.

Corrosion Erosion test

The corrosion erosion tests are done using 30% by weight 80 microns alumina suspended in 28% $P_2O_5$ synthetic acid, 1.5% $H_2SO_4$, 0.05% hydrofluoric acid plus 1000 ppm Cl, temperature 800° C., Rotation 650 RPM, Duration 12 hr. Mass loss (mg). The results of erosion corrosion testing are tabulated in Table 3 below.

TABLE 3

| Sample No. | Hardness BMN | Weight Loss (mg) | PREN = % Cr + 3.3 × % Mo + 16 × % N |
|---|---|---|---|
| U.S. Pat. 5,320,801 5 as cast | 260 | 306.6 | PREN (5) = 38 |
| 5 age hardened at 1400° F./4 hr. | 330 | 282.6 | |
| Present invention | | | |
| 8 - B | 530 | 96.3 | PREN (8B) = 53 |
| 8 as cast | 450 | 123.3 | PREN (8) = 53 |
| 8 anneal/S solution at 2000° F./4 hr. | 450 | 125.1 | |
| Stainless Steel CD4MCuN Solution Anneal | 280 | 426 | PREN = 38 (CD-4MCuN) |
| CD-4MCuN Age hardened | 330 | 328.2 | |
| 20Cb-3 solution anneal | 180 | 660.3 | PREN = 30 (20Cb-3) |

The slurry corrosion-erosion tests indicate that the most of the mass is lost from alloy 20Cb-3, which has the lowest hardness. Prior art alloy No. 5 has a low hardness, comparable to the hardness of the reference stainless steel CD-4MCuN.

The loss of mass on the sample No. 5 alloy of U.S. Pat. No. 5,320,801 is 50% less than on the sample of the stainless steel alloy Cd4MCuN. On the present invented alloy sample No8, the loss of mass is 245% less than on the reference alloy Cd4MCuN. The present invented alloy No.8 with the highest PREN factor=53, possesses the highest corrosion-erosion resistance ~3.5 times better than the reference alloy CD4MCuN and 2.3 times better than alloy No.5 of U.S. Pat. No. 5,320,801.

The present invented alloy with boron No.8B with the highest hardness and PREN=53 possess the highest corrosion-erosion resistance ~4.4 times better than the referenced alloy CD-4MCuN and 2.9 times better than alloy No.5 of the U.S. Pat. No. 5,320,801.

Any conventional or under nitrogen partial pressure casting technology may be used to produce the alloys of the present invention.

It is preferred that the alloys are formed by any conventional casting technology and then heat treated at a temperature in the range of 1800° to 2000° F., followed by air cooling.

The most preferred hardening method for the alloy of the present invention is by cryogenic treatment: cooling to at least from −100° F. to −300° degrees F., and maintaining at those temperatures for a time of one hour per one inch of casting wall thickness.

The cryogenic tempering process is performed with equipment and machinery which is conventional in the thermal cycling treatment field. First, the articles-under-treatment are placed in a treatment chamber which is connected to a supply of cryogenic fluid, such as liquid nitrogen or a similar low temperature fluid. Exposure of the chamber to the influence of the cryogenic fluid lowers the temperature until the desired level is reached. In the case of liquid nitrogen, this is about −300° F. (ie., 300° F. below zero).

Various changes and modifications may be made within the purview of this invention, as will be readily apparent to those skilled in the art. Such changes and modifications are within the scope and teachings of this invention as defined by the claims appended hereto. The invention is not to be limited by the examples given herein for purposes of illustration, but only by the scope of the appended claims and their equivalents.

What I claim is:

1. A corrosion and erosion resistant castable alloy comprising, in % by weight:

31 to 48 chromium 0.01 to 0.7 nitrogen 0.5 to 30 manganese 0.3 to 2.5 carbon 0.01 to 5 boron 0 to 6 molybdenum 0 to 5 silicon 0 to 8 copper 0 to 4 cobalt 0 to 25 nickel plus cobalt, said alloy further comprising 0 to 2% of each of one or more of zirconium, vanadium, cerium, titanium, tantalum, tungsten, niobium, aluminum, calcium and rare earth elements, the balance comprising iron and inevitable impurities, said alloy having a microstructure comprising chromium carbides, borides and nitrides in an austenitic matrix, said matrix having a face centered cubic crystal structure and being supersaturated with nitrogen in solid solution form, the composition of the alloy satisfying the equation:

$$\frac{\%Ni + \%Co + 0.5(\%Mn + \%Cu) + 30(\%N + \%C) + 5 \times \%B}{\%Cr + \%Mo + \%Si + 1.5(\%Ti + \%Ta + \%V + \%Nb + \%Ce + \%Al)} \geq 1.5.$$

2. The alloy of claim 1, wherein the alloy comprises of at least one of molybdenum, silicon, copper and (nickel plus cobalt), each in an amount of at least 0.01% by weight.

3. The alloy of claim 1, wherein the alloy comprises at least 32% by weight of chromium.

4. The alloy of claim 3, wherein the alloy comprises of at least one of molybdenum, silicon, copper and (nickel plus cobalt), each in an amount of at least 0.01% by weight.

5. The alloy of claim 3, wherein the alloy comprises, in % by weight:

32 to 34 chromium 0.35 to 0.45 nitrogen 6 to 9 manganese 0.5 to 2.5 carbon 0.01 to 4.5 boron 0 to 5 molybdenum 0 to 3 silicon 0 to 4 copper 0 to 4 nickel plus cobalt, the balance comprising iron and inevitable impurities.

6. The alloy of claim 5, wherein the alloy comprises, in % by weight, one or more of the following:

2 to 5 molybdenum 0.5 to 3 silicon 1 to 4 copper 2 to 4 nickel plus cobalt.

7. The alloy of claim 5, wherein the matrix comprises 0.35% by weight of nitrogen in solid solution form.

8. The alloy of claim 6, wherein the matrix comprises 0.35% by weight of nitrogen in solid solution form.

9. The alloy of claim 3, wherein the alloy comprises, in % by weight:

35 to 40 chromium 0.4 to 0.6 nitrogen 6 to 15 manganese 0.8 to 1.5 carbon 0.01 to 4 boron 0 to 5 molybdenum 0 to 3 silicon 0 to 6 copper 0 to 12 nickel plus cobalt, the balance comprising iron and inevitable impurities.

10. The alloy of claim 8, wherein the alloy comprises, in % by weight, one or more of the following:

2 to 5 molybdenum 0.5 to 3 silicon 1 to 6 copper 4 to 12 nickel plus cobalt.

11. The alloy of claim 9, wherein a PREN is from 58 to 66.

12. The alloy of claim 10, wherein a PREN is from 58 to 66.

13. The alloy of claim 11, wherein the matrix comprises 0.4% by weight of nitrogen in solid solution form.

14. The alloy of claim 12, wherein the matrix comprises 0.4% by weight of nitrogen in solid solution form.

15. The alloy of claim 3, wherein the alloy comprises, in % by weight:

41 to 48 chromium 0.45 to 0.7 nitrogen 6 to 30 manganese 0.9 to 1.5 carbon 0.01 to 3.5 boron 0 to 4 molybdenum 0 to 3 silicon 0 to 8 copper 0 to 25 nickel plus cobalt, the balance comprising iron and inevitable impurities.

16. The alloy of claim 15, wherein the alloy comprises, in % by weight, one or more of the following:

1 to 4 molybdenum 0.5 to 3 silicon 1 to 8 copper 10 to 25 nickel plus cobalt.

17. The alloy of claim 15, wherein a PREN is from 51 to 72.

18. The alloy of claim 16, wherein a PREN is from 51 to 72.

19. The alloy of claim 17, wherein the matrix comprises 0.45% by weight of nitrogen in solid solution form.

20. The alloy of claim 18, wherein the matrix comprises 0.45% by weight of nitrogen in solid solution form.

21. A casting which comprises the alloy of claim 1.

22. A part of a slurry pump which comprises the alloy of claim 1.

23. The part of claim 22, wherein the part comprises one of a casing, impeller, suction liner, pipe, nozzle, agitator and a valve blade.

24. The casting of claim 21, wherein the casting comprises the alloy of claim 10.

25. A casting which comprises the alloy of claim 10.

* * * * *